US007241106B2

(12) United States Patent
Aviña

(10) Patent No.: US 7,241,106 B2
(45) Date of Patent: Jul. 10, 2007

(54) COMBINED CYCLE BOUNDARY LAYER TURBINE

(76) Inventor: David Christopher Aviña, 105 Sycamore St., Bay St. Louis, MS (US) 39520

( * ) Notice: Subject to any disclaimer, the term of this patent is extended or adjusted under 35 U.S.C. 154(b) by 30 days.

(21) Appl. No.: 10/867,943

(22) Filed: Jun. 14, 2004

(65) Prior Publication Data

US 2005/0276681 A1 Dec. 15, 2005

(51) Int. Cl.
*F03B 5/00* (2006.01)

(52) U.S. Cl. ..... 415/90; 415/63; 415/66; 415/67; 415/100; 416/198 R

(58) Field of Classification Search ..... 415/90, 415/63, 66, 67; 416/198 R, 198 A
See application file for complete search history.

(56) References Cited

U.S. PATENT DOCUMENTS 2,632,598 A * 3/1953 Wales, Jr. ..... 416/4
3,007,311 A * 11/1961 Amero ..... 60/805
4,218,177 A * 8/1980 Robel ..... 415/90
4,586,871 A * 5/1986 Glass ..... 415/90

* cited by examiner

*Primary Examiner*—Ninh H. Nguyen

(57) ABSTRACT

A two staged fluid propulsion apparatus of the type which utilizes prior art pitched blades combined with solid boundary layer disks supported by a novel rotating tubular flow conduit perforated to allow fluid flow to from the interior of the tube to the exterior surface positioned to outlet into spaces between a plurality of solid disks mounted within a volute case housing containing a singular fluid outlet and in communication with a plurality of fluid inlet ports.

2 Claims, 4 Drawing Sheets

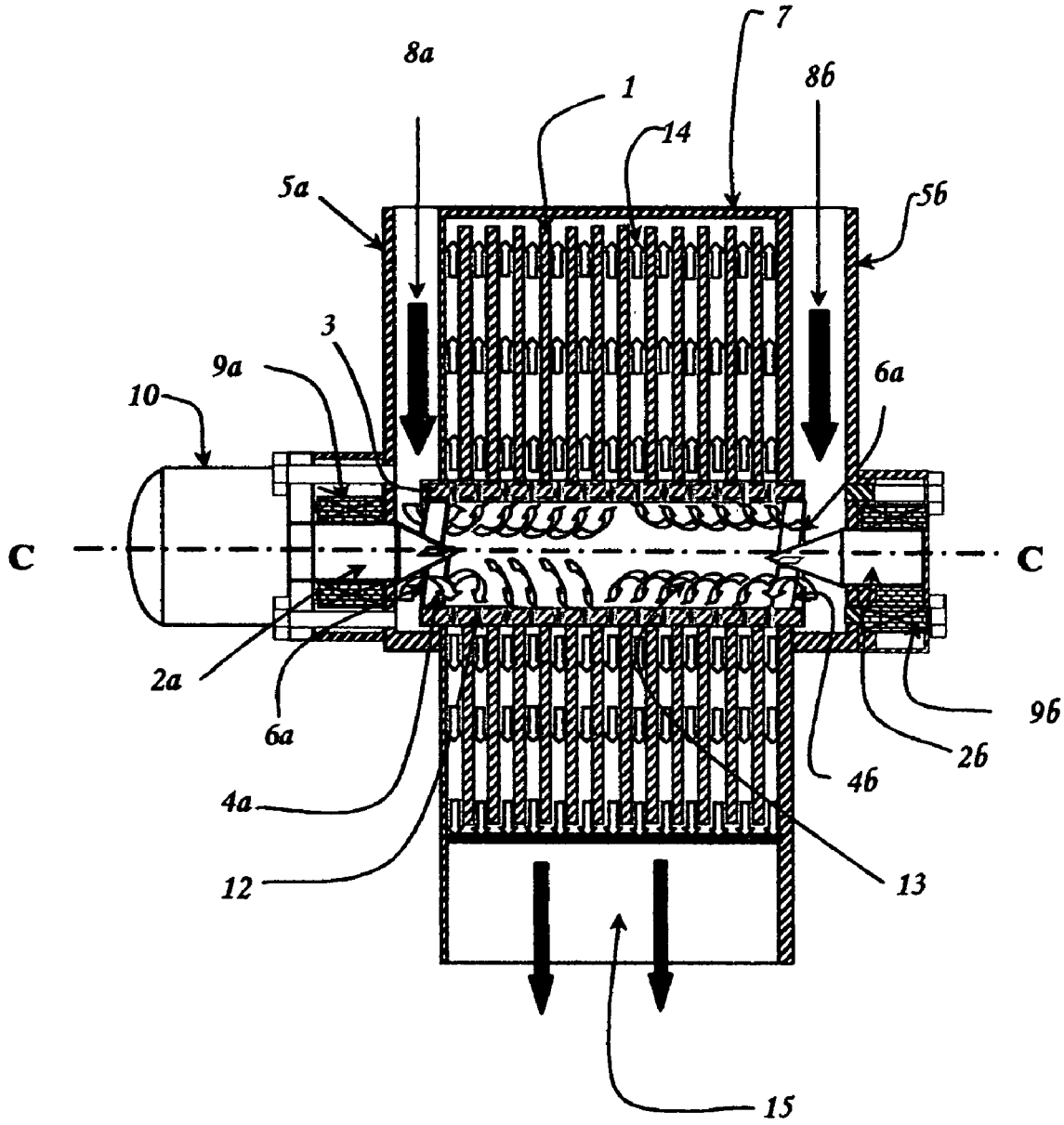
Figure One

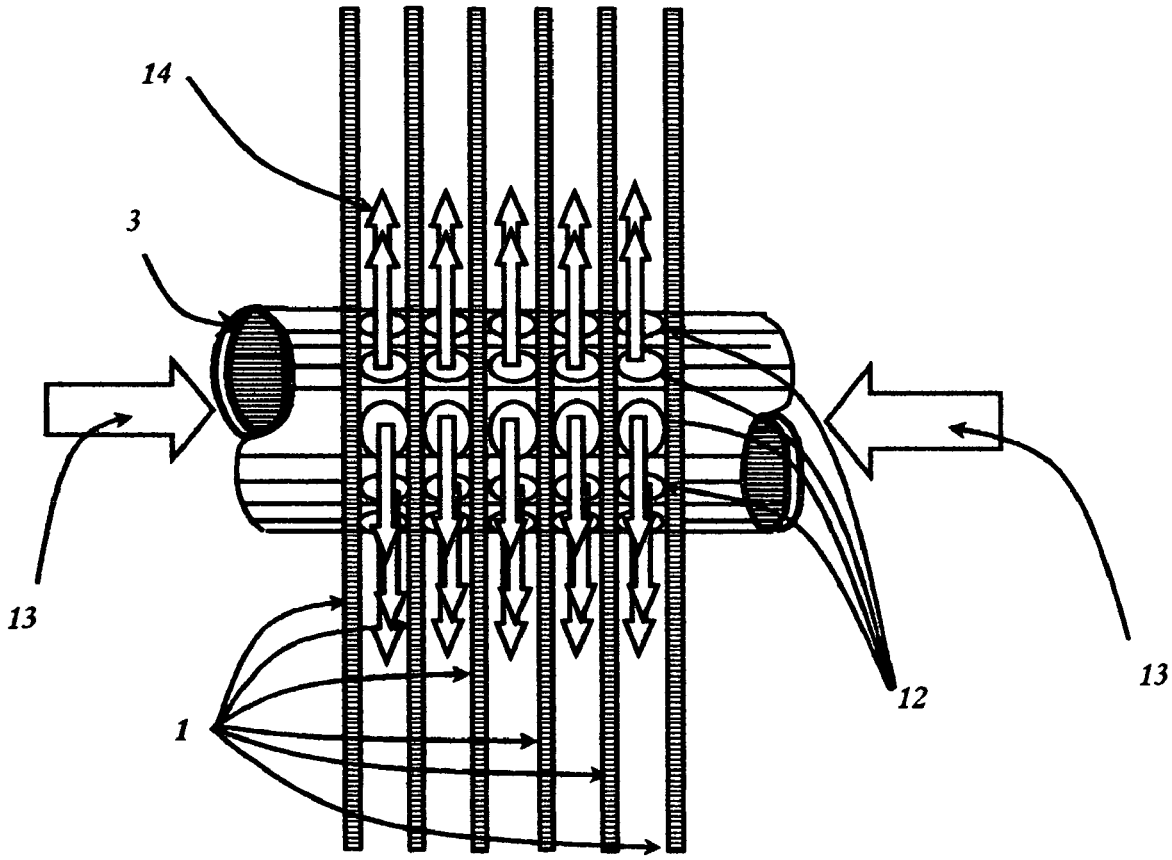
Figure Two

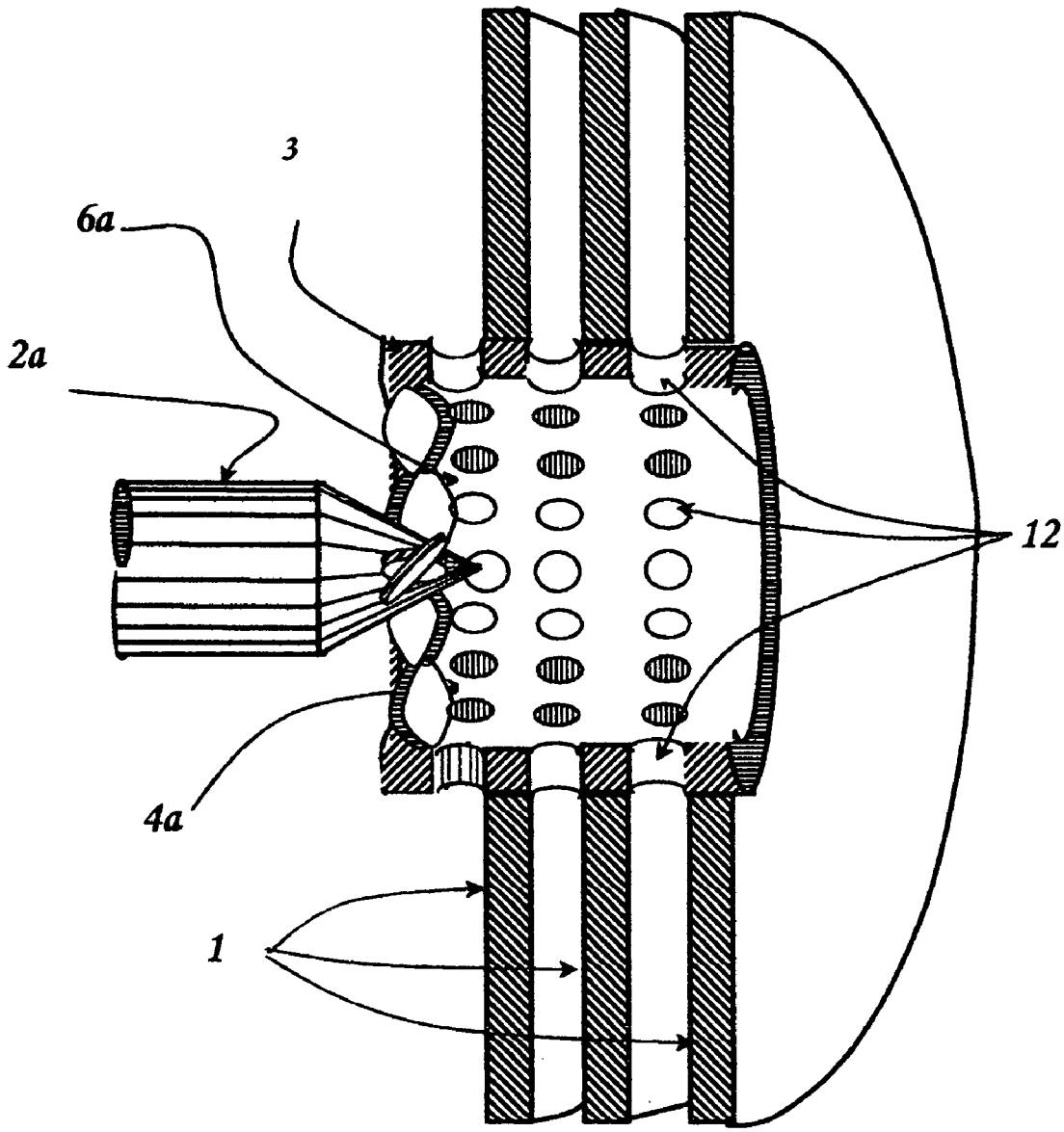
Figure Three

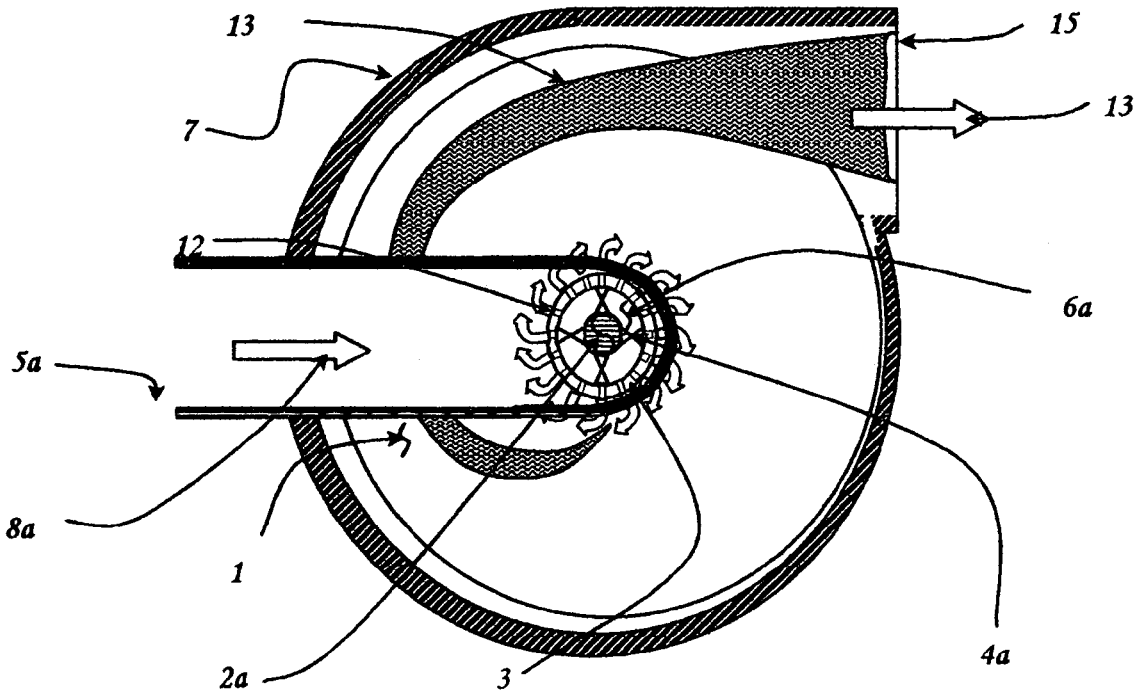
Figure Four

COMBINED CYCLE BOUNDARY LAYER TURBINE

BACKGROUND OF INVENTION

1. Field of the Invention

This invention relates to an apparatus used to communicate motive force between a plurality of rotating disks and a fluid, or conversely, may also be used to communicate motive force from a flowing fluid to a plurality of rotating disks.

2. History of Related Art

Taught first by Nikola Tesla in U.S. Pat. No. 1,061,142, (Tesla) and U.S. Pat. No. 1,061,206 (Tesla), disclosure of which is incorporated herein by reference. In both disclosures the rotor (runner) comprises a stack of flat circular discs with spoke opening in the central portions, with the disk being set slight apart. In the propulsion embodiment, fluid enters the system at the center of the rotating discs and is transferred by means of viscous drag to the periphery where it is discharged tangentially. In the turbine embodiment, fluid enters the system tangentially at the periphery and leaves it at the center. As taught by Tesla, the use of a boundary layer (adherence and viscosity), to communicate motive force on a plurality of rotating disks improves upon the art of propulsion. Tesla teaches "It may be also be pointed out that such a pump can be made without openings and spokes in a runner by using one or more solid disks each in it's own casing to form a machine will be eminently adapted for sewage, dredging and the like, when the water is charged with foreign bodies and spokes and vanes especially objectionable". Tesla also teaches "Besides, the employment of the usual devices for imparting to, or deriving energy from a fluid, such as positions, paddles, vanes and blades, necessary introduce numerous defects and limitations and adds to the complication, cost of production and maintenance of the machine". Prior art has employed pin attachments, channels, and spokes to obtain a rotor design with an open center. It is considered that this arrangement of spokes, pins, channels is not desirable in propulsion or turbine for the following reasons:

(a) Pin attachments used to retain and space the plurality of rotor disks travel a perpendicular path in relation to the spiral path of the fluid flow to cause a disrupted flow pattern and generate a turbulent interference pattern to disrupt the desirable laminar flow that provides an optimal boundary layer effect for maximum uniform cohesion of the fluid to the disk(s).

(b) A disk rotor supported in a cantilever fashion to allow an open end for fluid passage through an open center provides a radius of rotation causing vibration in the fluid and disk rotor increasing boundary layer disruption.

(c) Spokes are used to attach disks to a rotating axle provide unequal mass distribution of the disks which under high speed rotation result in stress causing deformation of the disk surface, and vibration known to cause disruption of the boundary layer viscous flow and possible disk failure.

Tesla teaches that the highest economy is obtained when for any given speed the slip should be as small as possible. As the boundary layer effect is enhanced by viscous flow reducing slip, therefore, turbulent flow reduces viscous flow increasing slip.

It is these issues that have brought about the present invention.

SUMMARY OF THE INVENTION

In accordance with the instant invention, there is provided a novel employment in boundary layer turbine design as depicted in prior art reference, this novel approach utilizes impeller blades as well as bladeless disk to obtain a even flow, undisrupted boundary layer distribution, and the use of a plurality of solid disk contained within a common housing supplied by two opposing inlets and one outlet port. Instant invention eliminates spokes, pins, rods, sleeves, spacers, and star washers from it construction. This improvement simplify construction, reduces weight, improves structural integrity, reduces vibration, and provides the full surface of the boundary layer disk for propulsion, resulting in a high efficiency fluid propulsion system. Prior art has shown that boundary layer viscous flow can be used to impart motion to a fluid with a plurality spaced apart disks in rotation by mechanical means. It is also known that pitched turbine blades also, impart motion to a fluid in contact with the blades to a degree of efficiency. It is also known that a fluid with resonates flowing through spherical shaped ports positioned closely together create a interference wave that cancels out a degree of vibration. The invention being described utilizes these mechanical and dampening effects to overcome known undesirable attributes of prior art designs utilizing devices of similar design and shall be described as follows:

The present invention is a combined cycle propulsion apparatus comprising:

(a) a first volute case housing in communication with a plurality of inlets and a singular outlet.

(b) a plurality of rotating shafts supported by bearings attached to and in communication with a third rotating tubular flow conduit armature.

(c) a plurality of impeller blades affixed to the ends of the plurality of drive shafts and attached to and in communication with the open ends of the third main tubular flow conduit armature in providing rotation to and fluid compression within the interior of the third main flow conduit shaft.

(d) a plurality of spaced solid disks contained within said volute case housing, and mounted around a third main tubular flow conduit armature rotating shaft in communication with the plurality of inlets and singular outlet openings.

(e) a plurality of manifold ports arranged circumferentially about the diameter of third main flow conduit rotating shaft spaced evenly between the plurality of flow generating boundary layer disks.

BRIEF DESCRIPTION OF THE DRAWINGS

FIG. 1 is a vertical cross section of the embodiment of combined cycle propulsion apparatus.

FIG. 2 is a vertical section of the tubular conduit armature.

FIG. 3 is a vertical cross-section view of one end of the drive shaft, tubular flow conduit armature inlet, and inlet turbine blades with a manifold of disk flow ports to communicate the fluid flow into the space between the boundary layer disks.

FIG. 4 is a vertical cross-sectional of the combined cycle turbines housing showing even air flow distribution.

DETAILED DESCRIPTION

The present invention will be described with reference to the accompanying drawings which assist in illustrating the pertinent features thereof. The apparatus illustrated in FIG. 1 a vertical cross section of the embodiment of combined cycle propulsion apparatus comprises of the propulsion of a inlet fluid (8*a*, 8*b*) through plurality of inlets (5*a*,5*b*), in communication with volute casing (7), to a plurality of tubular conduit inlet openings (6*a*,6*b*), This flow of the fluid is promoted by a plurality set of pitched impeller blades (4*a*, 4*b*) that imparts motive force to inlet fluid (8*a*, 8*b*) by the applied rotation of a plurality set of pitched impeller blades (4*a*, 4*b*) coupled to a plurality of drive shafts (2*a*, 2*b*) mechanical means supplied electric motor (10) that is coupled to a plurality of drive shafts (2*a*, 2*b*) in more or less free rotation around axis (C-C) and supported for rotation by bearings (9*a*, 9*b*), and also coupled to a tubular flow conduit armature (3). As inlet fluid (8*a*, 8*b*) is propelled from the inlet openings (6*a*,6*b*) into tubular conduit armature (3) under pressure generated by a plurality set of pitched impeller blades (4*a*, 4*b*) at speeds, fluid pressure occurs within the interior of the tubular flow conduit armature (3) forcing fluid to flow through a plurality of manifold ports (12) located in the spaces between the plurality of boundary layer disks (1) mounted to the exterior circumference of the tubular flow conduit armature (3). As fluid flow is forced by the impeller blades (4*a*, 4*b*) into the spaces between boundary layer disks (1) a frequency is expected to be imparted to the flowing fluid (13) by a plurality set of pitched impeller blades (4*a*, 4*b*), and into tubular flow conduit armature (3) it is propelled through a plurality of spherical shaped manifold ports (12), under pressure and frequency that generates a dipole source effect propagated by the proximity of manifold ports (12) from one another to cause a damping of frequency emission being conducted to the boundary layer through flowing fluid (13) and reverberated by the plurality of boundary layer disks (1).

As turbulence is known to be a key factor in the disruption of a boundary layer effect causing slip between the flowing fluid (14) and the plurality of boundary layer disks (1), This reduction of vibratory effects also reduces uneven stresses occurring in the plurality of boundary layer disks (1) known to cause deformation and failure. As rotation the plurality of boundary layer disks (1) around axis (C-C) fluid flow (14) is placed under an increased pressure against the volute casing forcing flow from outlet port (15).

FIG. 2 illustrates a vertical section view of a portion of the tubular flow conduit armature (3), detailing the passage of fluid flow (13) flowing on the interior of the tubular flow conduit armature (3) and fluid flow (14) flowing out of a plurality of manifold ports (12) positioned in the spaces between a plurality of disks (1).

FIG. 3 A vertical cross-section of the interior of one end of tubular flow conduit armature (3), with inlet (6*a*), a detail of one embodiment of the fixed blades (4*a*) and showing the location and position of attachment to the solid drive shaft (2*a*), also indicated is the approximate location of a plurality of manifold ports (12) positioned between boundary layer disks (1).

FIG. 4 is a vertical cross-sectional of the end of the combined cycle turbine showing inlet fluid flow (8*a*) passage into one inlet (5*a*) in communication with go the tubular flow conduit armature (3) through inlet (6*a*) propelled by pitched turbine blades (4*a*) into the end of the tubular flow conduit armature (3) fluid (13) now acting under pressure and in communication with manifold ports (12).

As fluid (13) is propelled in a tangential fashion by a plurality of boundary layer disks (1) with and increase in pressure of boundary layer disk propelled fluid (13) against the interior of the volute case housing (7) it is propelled out of volute case outlet (15) at pressure and velocity.

The turbine blade propulsion and boundary layer propulsion have been described previously in detail as to structure and the method of using the same and need not to be repeated.

The invention claimed is:

1. A boundary layer propulsion apparatus for use in transferring a fluid from a first location to a second location utilizing a tubular flow conduit armature located within a confined space with at least one inlet and at least one outlet which includes:

a. a centrifugal volute casing having a first and second side walls and an outlet extends between the first and second side walls;

b. at least one inlet passages coupled to a side wall of the volute casing;

c. a rotor comprising:

d. a movable tubular flow conduit armature positioned inside said volute casing and in fluid communication with the said inlet passages;

e. a driven shaft coaxial with and located adjacent to one end of the tubular flow conduit armature, the driven shaft comprising a first blunt end coupled to a motor, and a second conical shaped free end; a plurality of first impeller blades extend radially from the second conical shaped free end toward the one end of the tubular flow conduit armature and coupled to the inside surface of the tubular conduit at the one end;

f. an idler shaft coaxial with and located adjacent to the other end of the tubular flow conduit armature, the idler shaft having a second blunt end and a second conical shaped free end, a plurality of second impeller blades extend radially from the second conical shaped free end toward the other end of the tubular flow conduit armature and coupled to the inside surface of the tubular conduit at the other end;

g. a plurality of axially spaced solid boundary layer disks attached to the outside surface of the tubular flow conduit armature;

h. a plurality of manifold ports formed through the outer surface of the tubular conduit between adjacent axially spaced between said boundary layer disks;

wherein the driven and idler shafts each is supported by at least one bearing disposed in a bearing housing attached to the outside of a respective side wall of the volute casing; the bearing housing further comprises seal means to prevent leakages;

wherein the inlet fluid from a first location flowing into the inlet passage(s), under pressure generated by the pitched impeller blades, accelerates into the tubular flow conduit armature, exits through the plurality of manifold ports into spaces between said plurality of flow generating disks into the inside of the volute and moves radially outward in a spiral path to the outlet(s) due to the centrifugal force imparted through boundary effects of cohesion by said plurality of axially spaced disks and exits to a second location.

2. A method of propulsing fluid from a first location to a second location comprising the steps of:

a. providing a centrifugal volute casing having a first and second sidewalls and an outlet extends between the first and second sidewalls;

b. providing at least one inlet passage coupled to a sidewall of the volute casing;

c. providing a rotor comprising:

d. a movable tubular flow conduit armature positioned inside said volute casing and in fluid communication with said at least one inlet passage;

e. a driven shaft coaxial with and located adjacent to one end of the tubular flow conduit armature, the driven shaft comprising a first blunt end coupled to a motor, and a second conical shaped free end; a plurality of first impeller blades extend radially from the second conical shaped free end toward the one end of the tubular flow conduit armature and coupled to the inside surface of the tubular conduit at the one end;

f. an idler shaft coaxial with and located adjacent to the other end of the tubular flow conduit armature, the idler shaft having a second blunt end and a second conical shaped free end, a plurality of second impeller blades extend radially from the second conical shaped free end toward the other end of the tubular flow conduit armature and coupled to the inside surface of the tubular conduit at the other end;

g. a plurality of axially spaced solid boundary layer disks attached to the outside surface of the tubular flow conduit armature;

h. a plurality of manifold ports formed through the outer surface of the tubular conduit between adjacent axially spaced between the boundary layer disks;

i. providing at least one bearing disposed in a bearing housing attached to the respective side wall of the volute casing to support the idler shaft; wherein the bearing housing further comprising seal means to prevent leakages;

j. rotating the impeller blades to accelerate inlet fluid from a first location through the at least one inlet passage into the tubular flow conduit armature;

k. directing the fluid through the plurality of manifold ports into spaces between said plurality of axially spaced boundary layer disks;

l. utilizing the centrifugal force generated by the boundary effects of cohesion from the plurality of rotating boundary layer disks to impart a spiral flow path to the fluid inside the volute, and m. exiting the fluid to a second location.

* * * * *